US007819341B2

(12) United States Patent
Schmon et al.

(10) Patent No.: US 7,819,341 B2
(45) Date of Patent: Oct. 26, 2010

(54) PAINT RESERVOIR SYSTEM FOR A PAINT SPRAY GUN

(75) Inventors: Ewald Schmon, Grafenberg (DE); Peter Dettlaff, Remseck (DE)

(73) Assignee: Sata GmbH & Co. KG, Kornwestheim (DE)

( * ) Notice: Subject to any disclaimer, the term of this patent is extended or adjusted under 35 U.S.C. 154(b) by 663 days.

(21) Appl. No.: 10/597,152

(22) PCT Filed: Jan. 18, 2005

(86) PCT No.: PCT/EP2005/000435

§ 371 (c)(1),
(2), (4) Date: Jan. 9, 2007

(87) PCT Pub. No.: WO2005/070557

PCT Pub. Date: Aug. 4, 2005

(65) Prior Publication Data

US 2008/0179763 A1 Jul. 31, 2008

(30) Foreign Application Priority Data

Jan. 22, 2004 (DE) ..... 10 2004 003 439

(51) Int. Cl.

| | |
|---|---|
| ***B05B 9/04*** | (2006.01) |
| ***B05B 9/047*** | (2006.01) |
| ***B05B 11/02*** | (2006.01) |
| ***B05B 9/00*** | (2006.01) |
| ***B65D 35/56*** | (2006.01) |

(52) U.S. Cl. ..... 239/321; 239/379; 239/320; 239/302; 239/316; 222/105; 222/183

(58) Field of Classification Search ..... 239/345, 239/526, 525, 309, 347, 376, 328, 379, 302, 239/308, 409, 414, 527, 321, 320, 316; 222/105, 222/183, 160, 566, 498, 499, 502–544, 546–564, 222/519, 520, 522, 523–525; 220/360, 345.4, 220/345.1, 287

See application file for complete search history.

(56) References Cited

U.S. PATENT DOCUMENTS 2,559,091 A * 7/1951 Reasenberg ..... 424/43

(Continued)

FOREIGN PATENT DOCUMENTS

CH 203 668 A 3/1939

(Continued)

OTHER PUBLICATIONS

International Search Report PCT/EP2005/000435.

(Continued)

*Primary Examiner*—Len Tran
*Assistant Examiner*—Justin Jonaitis
(74) *Attorney, Agent, or Firm*—Martin Fleit; Paul D. Bianco; Fleit Gibbons Gutman Bongini & Bianco PL

(57) ABSTRACT

The invention relates to a gravity flow reservoir for a paint spraying gun having a container and a cover, which can be placed thereon and which has a connecting part in order to place the gravity flow reservoir onto the paint spraying gun or onto an adapter. Prior art reservoirs require a separate pointed tool, which serves to make a vent hole, is often unavailable and can lead to operating errors. The aim of the invention is to provide a paint reservoir system that enables a simple, rapid and uncomplicated insertion of a vent hole into the container wall of the gravity flow reservoir while preventing shavings or plastic parts from entering the gravity flow reservoir. To this end, a delimited area is provided in the wall of the container and can be penetrated by the pointed tool in order to make a vent hole.

5 Claims, 2 Drawing Sheets

U.S. PATENT DOCUMENTS

| | | | | |
|---|---|---|---|---|
| 4,210,263 | A * | 7/1980 | Bos | 222/449 |
| 4,946,075 | A | 8/1990 | Lundbäck | |
| 5,582,350 | A * | 12/1996 | Kosmyna et al. | 239/345 |
| 5,954,268 | A * | 9/1999 | Joshi et al. | 239/34 |
| 6,536,687 | B1 * | 3/2003 | Navis et al. | 239/345 |
| 6,553,712 | B1 * | 4/2003 | Majerowski et al. | 43/131 |
| 6,595,441 | B2 | 7/2003 | Petrie et al. | |
| 6,692,118 | B2 * | 2/2004 | Michele et al. | 347/86 |
| 7,416,140 | B2 * | 8/2008 | Camilleri et al. | 239/321 |
| 2003/0121476 | A1 * | 7/2003 | McIntyre et al. | 119/71 |
| 2006/0113409 | A1 * | 6/2006 | Camilleri et al. | 239/600 |
| 2007/0205305 | A1 * | 9/2007 | Vagedes | 239/302 |

FOREIGN PATENT DOCUMENTS

| | | | |
|---|---|---|---|
| DE | 80 24 829.9 | | 9/1982 |
| DE | 3526819 | A1 | 2/1987 |
| DE | 89 05 681.7 | | 11/1989 |
| FR | 2 570 140 | A | 3/1986 |
| FR | 2 570 140 | A | 4/1986 |
| FR | 2 774 928 | A | 8/1999 |
| WO | WO 01/12337 | | 2/2001 |
| WO | WO 01/12337 | A1 | 2/2001 |
| WO | WO 03/045575 | | 6/2003 |
| WO | WO 03/045575 | A1 | 6/2003 |

OTHER PUBLICATIONS

International Preliminary Report on Patentability PCT/EP2005/000435.

Written Opinion of the International Search Authority PCT/EP2005/000435.

English translation of International Preliminary Report on Patentability published Oct. 3, 2006 for PCT/EP2005/000435, filed Jan. 18, 2005.

* cited by examiner

PAINT RESERVOIR SYSTEM FOR A PAINT SPRAY GUN

FIELD OF THE INVENTION

The invention relates to a flow reservoir for a paint spray gun, to a pointed tool, especially a spike, for puncturing a ventilation opening in the wall of a paint spray gun paint reservoir and to a paint reservoir system consisting of a flow reservoir and a pointed tool.

BACKGROUND OF THE INVENTION

Flow reservoirs are known from the prior art, e.g., U.S. Pat. No. 6,536,687 B1 and FR 2 774 928-A. These include a container made from plastic and a cover that can be placed on the container for closing the container. There are attachment means on the top side of the cover for setting and fastening the flow reservoir on a paint spray gun. Here, the flow reservoir is set on the paint spray gun "upside-down," thus with the cover side pointing downwards. The paint in the flow reservoir then flows downwards, due to gravity, into the paint inlet channel of the paint spray gun. To enable the gravity fed flow of the paint, the pressure within the paint reservoir must be equalized. Here, as described in the mentioned publications, a ventilation opening is punctured in the container floor or in the side wall of the container near the container floor by means of a needle after the paint container has been set on the paint spray gun "upside-down," thus with the container floor pointing upwards.

To form the ventilation opening in the container wall, a separate pointed tool, e.g., a needle or a spike, is required. Such a tool is often not available. Furthermore, puncturing the container wall, which is generally made from hard plastic, with a suitable pointed tool has also proven to be difficult. In addition, there is the risk that plastic chips or parts will fall into the paint in the paint reservoir due to pressing an opening in the container wall.

SUMMARY OF THE INVENTION

Starting with these disadvantages associated with the known flow reservoirs, the invention is based on the task of presenting a paint spray gun paint reservoir system that enables a simple, fast, and uncomplicated formation of a ventilation opening in the container wall of the flow reservoir, and which prevents chips or plastic parts from finding their way into the flow reservoir.

This task is achieved with a flow reservoir with the features of independent claims 16 and 19, and a pointed tool, especially a spike, with the features of independent claims 16 and 19.

BRIEF DESCRIPTION OF THE DRAWINGS

The invention is described in more detail in the following with reference to the attached drawings of an embodiment. The drawings show.

DETAILED DESCRIPTION OF THE INVENTION

Figure 1:
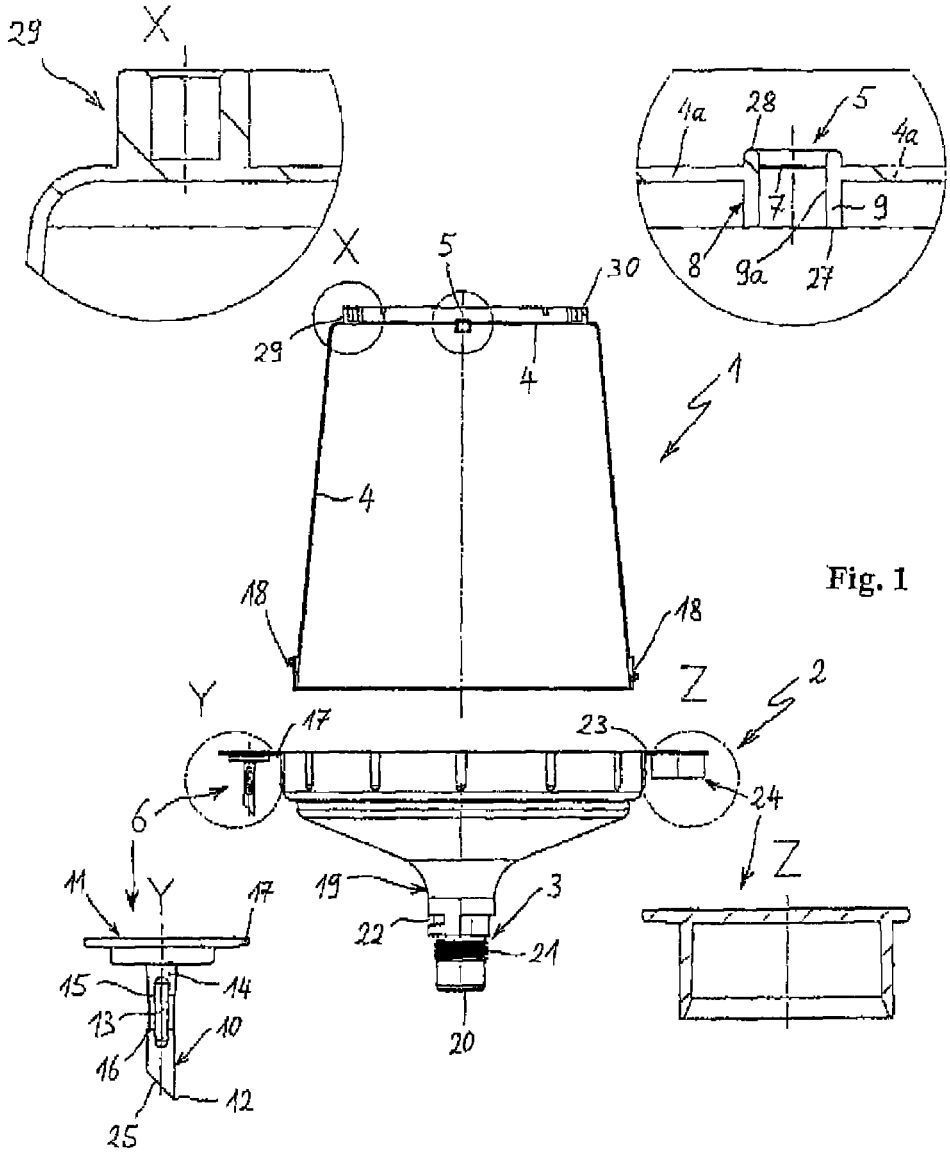
FIG. 1: a side view of a flow reservoir with a container and a cover that can be placed on the container, as well as detail views thereof (details X, U, Y, Z)

In FIG. 1, a flow reservoir for a paint spray gun is shown that includes a container 1 and a cover 2 that can be screwed onto the container by means of a thread 18. Here, the flow reservoir is shown in FIG. 1 in the position in which the flow reservoir is set on the paint spray gun, thus with the top side of the cover 2 pointing downwards. The cover 2 has an outlet port 19 with an outlet opening 20 in its top side. An attachment part 3 is formed on the outer side of the outlet port 19. The attachment part 3 is used for setting and fastening the flow reservoir on a paint spray gun, or on an adapter arranged between the paint spray gun and the flow reservoir. In the embodiment shown in FIG. 1, the attachment part 3 includes a thread 21 and a wedge-shaped groove 22, which interacts with corresponding attachment parts of the paint spray gun, namely a corresponding internal thread and a peg for engaging in the groove 22.

The container 1 is bowl-shaped with a circular container floor and a side wall extending slightly conically upwards from the container base. The container wall forming the container floor or the side wall is here designated with reference symbol 4. The container wall 4 is produced from plastic in one piece in an injection-molding process. There is a defined region 5 in the base part of the container 1. This defined region 5 is used for a later formation of a ventilation opening and is defined by the region 4*a* of the container wall 4 surrounding it such that it is formed on one side as a membrane 7 with a smaller thickness than the thickness of the region 4*a* surrounding the region 5, and on the other side is bordered by a guidance surface 9*a* that is used to guide the pointed tool when the ventilation opening is punctured at a later time. In the embodiment schematically shown here, the guidance surface 9*a* is formed by the inner side of a wall 9 of a hollow cylinder 8 standing essentially perpendicular to the container wall 4. The hollow cylinder 8 with its radial wall 9 and the membrane 7, which runs approximately in the region of the base surface of the hollow cylinder 8, can be seen in the detail view "U" of FIG. 1.

Two hollow cylinders 29 and 30, which project outwards beyond the container wall 4, are further formed on the reservoir base.

A spike 6 and a sealing cap 24 are each attached to the cover 2 by corresponding tear-off brackets 17, 23. The tear-off brackets 17 and 23 are formed as intended breaking points, so that the spike 6 and the sealing cap 24 can be torn from the cover 2 by hand without the help of a tool. The sealing cap 24 is used for closing the opening 20 of the cover 2. The spike 6 is used for forming a ventilation opening in the defined region 5 of the container wall 4.

Figure 2:
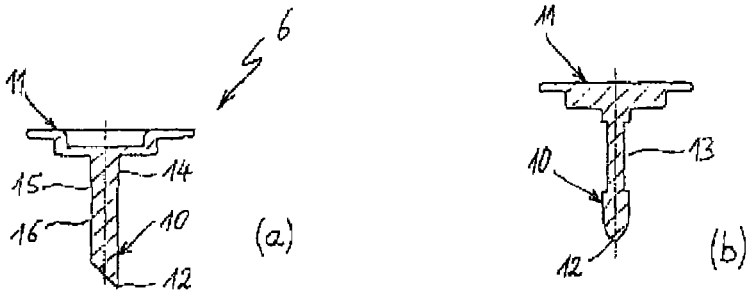
FIG. 2: sectional views of a spike as shown in the detail view "Y" in FIG. 1, wherein the view according to FIG. 2*a* shows a section through the plane of the paper for view "Y" of FIG. 1 and the view according to FIG. 2*b* shows a section through a plane perpendicular to this.

The spike 6 shown in a side view in the detail view "Y" of FIG. 1 and in sectional views in FIG. 2 has a cylindrical shaft 10 and a head part 11 arranged at one end of the shaft. The projection 14 of the shaft bordering the head part 11 extends conically to the head part 11. The free end 25 of the shaft 10 is beveled to form a point 12. The diameter of the shaft in the region of the free end 25 corresponds to the inner diameter of the hollow cylinder 8 arranged on the floor of the flow reservoir. In the center region of the shaft 10, there are two recesses 13 arranged at diametrically opposite points on the shaft circumference. Furthermore, the shaft 10 has a circular ring groove 26 (FIG. 3*c*) with a slightly smaller diameter than the remaining shaft region. Two radial catch edges 15 and 16, which are arranged at a distance to each other, are formed by the ring groove 26 on the shaft periphery. The recesses 13 extend in the longitudinal direction of the shaft over an extent that corresponds to approximately half the shaft length, and are arranged so that they extend past both catch edges 15, 16, as shown in the detail view "Y" of FIG. 1.

The paint reservoir system consisting of the flow reservoir and the spike 6 is used as follows:

First, the container 1 is set on the container base and the cover 2 is unscrewed. Then, the container 1 can be filled with paint and the cover 2 can be screwed on to seal the container 1. The container 1 with screwed-on cover 2 is then turned over and placed on the paint spray gun. Then, with the help of the spike 6 torn from the cover 2, a ventilation opening is punctured in the defined region 5 of the container wall 4. Here, the point 12 of the spike 6 is pressed through the membrane 7, which tears the membrane 7. The wall 9 of the hollow cylinder 8 projecting into the container interior is used as a guide for the shaft 10 for introducing the spike 6.

Figure 3:
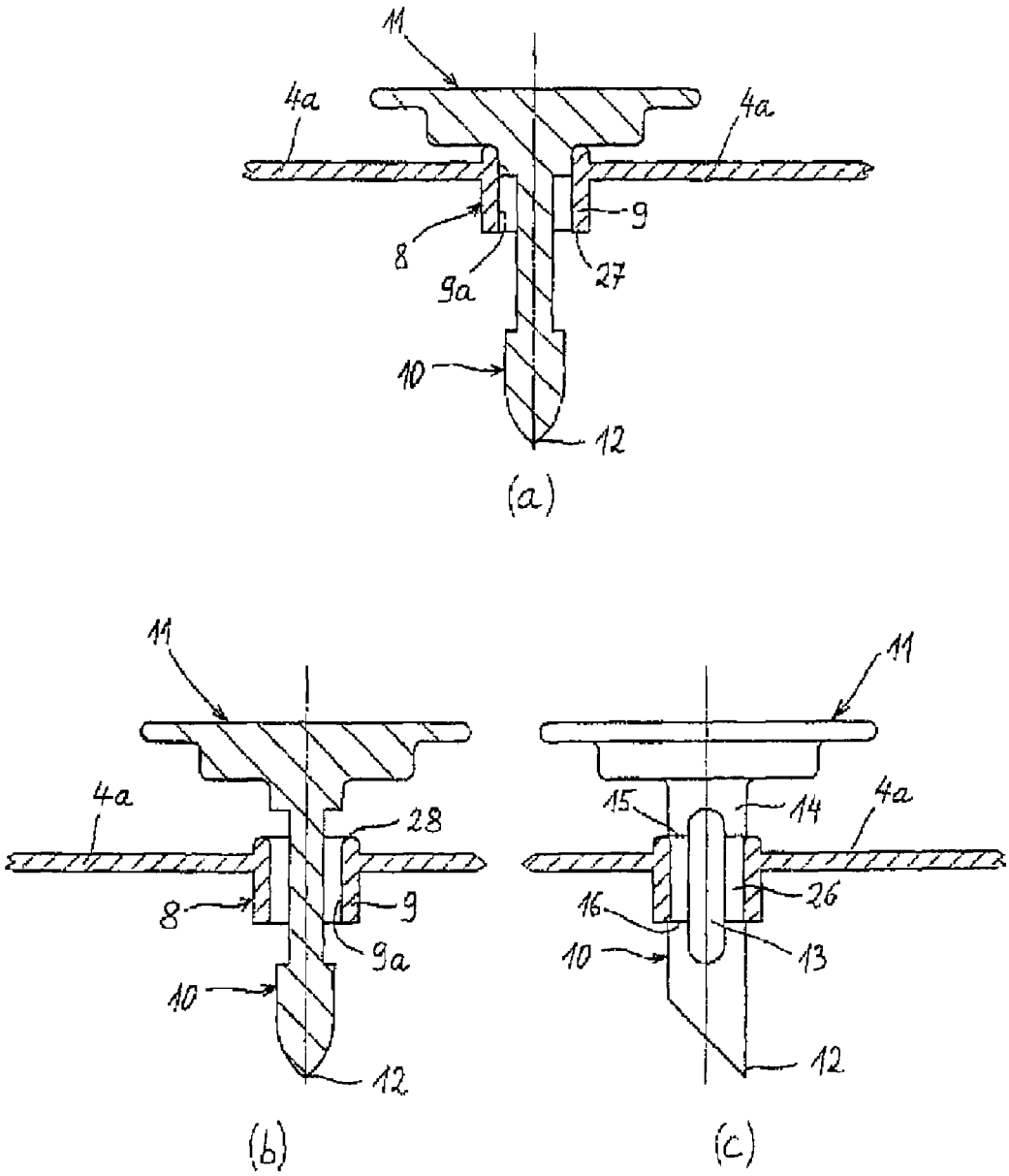
FIG. 3: a view of the detail region "U" of FIG. 1 with the spike having punctured the container wall, in various positions, wherein the views according to FIGS. 3*a* and 3*b* are sections and the view of FIG. 3*c* is a half-section.

The spike 6 is then pressed further into the container interior until the lower catch edge 16 is flush in the container interior with the lower edge 27 of the hollow cylinder 8 and the upper catch edge 15 contacts the upper edge 28 of the hollow cylinder 8 respectively, as shown in FIG. 3*c*. In this position, the recesses 13 are located at the height of the region 4*a* of the container wall 4 bordering the punctured ventilation opening, and thus form a ventilation channel that enables pressure equalization between the container interior and the surroundings (FIG. 3*b*).

The upper catch edge 15 should prevent the spike 6 from sliding further into the container interior by itself, thus because of gravity only, with no application of external force. If the spike were to slide farther into the container, it could close the ventilation channel. The spike 6 can naturally slide into the container interior by itself at most until the upper catch edge 15 contacts the upper edge 28 of the hollow cylinder 8, as shown in FIG. 3*c*. For an inverted position of the container 1, the lower catch edge 16 prevents, in a corresponding way, the spike 6 from sliding out of the ventilation opening by itself, because the spike 6 can slide out from the container interior at most until the lower catch edge 16 contacts the lower edge 27 of the hollow cylinder 8.

After the painting process is completed, the ventilation opening can be closed by pressing the spike 6 farther into the container opening until the bottom side of the head part 11 contacts the upper side 28 of the hollow cylinder 8, as shown in FIG. 3*a*. In this position, the conical shaft beginning part 14 jams in the upper region of the hollow cylinder 8 and thus closes the ventilation opening, as shown in FIG. 3*a*.

Relative to known paint reservoir systems, the invention is characterized in that a ventilation opening can be punctured in the flow reservoir in a simple way by means of the pointed tool in the form of the spike 6. Here, the region of the container wall of the flow reservoir for forming the ventilation opening is defined and configured such that an opening can be punctured more easily, e.g., by the guidance surface projecting into the container interior and the thin membrane 7 that can be easily punctured with a pointed tool.

The invention claimed is:

1. Paint reservoir system for a paint spray gun including an open top container and a cover having a spout that can be set on the container to close the top, the spout of said cover being mountable on a paint spray gun for gravity feed of the paint from the container to the spray gun;

a first through member sealed by a readily puncturable membrane is formed integrally in a wall of the container for establishing a sealed but readily puncturable ventilation opening; said membrane consisting of a material with one of (i) a lower strength than the material of the container wall and (ii) a smaller thickness than the container wall;

a second member being slidably receivable in said first through member and having a tapered forward end that can puncture said membrane and an enlarged rear end that can engage the first through member; said second member being positionable in said first through member in a first position in which the membrane has been punctured and the second member forms an airtight seal with the first through member, and in a second position in which the membrane is punctured, the second member is partially withdrawn from said first though member and an air passage is formed between the first and second members enabling air relief of the container.

2. Paint reservoir system according to claim 1 wherein the first through member has a forward end and a rear end is integrally formed with the bottom of the container and is in the form of a through tubular cylinder essentially perpendicular to the bottom of the container.

3. Paint reservoir system according to claim 2 wherein the forward end of the tubular cylinder projects into the interior of the container and the membrane seals the rear end of the tubular cylinder.

4. In a paint reservoir system for a paint spray gun including a flow reservoir composed of an open top container for paint closed by a cover having a spout for mounting the system on a paint spray gun for gravity feed of the paint from the container to the spray gun and a device for ventilating the container during gravity feed of the paint to the spray gun, the improvement wherein the ventilation device comprises in combination (a) a tubular cylinder having a central axis, an outer surface and an inner surface that bounds and defines an interior space having a preselected cross section and shape, (b) said tubular cylinder integrally formed with a wall of the container with its central axis essentially perpendicular to the container wall and defining a passageway through said wall, (c) a readily puncturable membrane integrally formed to seal the passageway through the tubular cylinder in a liquid-tight manner, and (d) a member readily detachably mounted on the paint reservoir system for forming a ventilation opening through said puncturable membrane, (e) said member having a forward end configured to puncture through the membrane and a rear end for engaging the tubular cylinder; said member being shaped to define a ventilation opening between its ends, (f) said inner surface of said tubular cylinder providing a guidance surface for the member, (g) whereby when the member is detached from said paint reservoir system and inserted into the tubular cylinder, the forward end of the member engages the inner surface of the tubular cylinder and is positively guided by said guidance surface to puncture said membrane, and thereafter, to reside normally at rest in said tubular cylinder in one of two stable positions, (i) in a first stable position to be partially withdrawn to enable ventilation of the container, and (ii) in a second stable position with the member in liquid-tight engagement with the tubular cylinder.

5. In a paint reservoir system according to claim 4 wherein the second member is a pointed tool detachably mounted to the cover by a tear-off bracket.

* * * * *